US007883066B2

(12) United States Patent
Wiese

(10) Patent No.: US 7,883,066 B2
(45) Date of Patent: Feb. 8, 2011

(54) CORNER BRACKET SYSTEM FOR WALL HANGINGS AND METHOD FOR USE

(75) Inventor: Benjamin Wiese, Woodward, IA (US)

(73) Assignee: K & B Innovations, Inc., Granger, IA (US)

( * ) Notice: Subject to any disclaimer, the term of this patent is extended or adjusted under 35 U.S.C. 154(b) by 101 days.

(21) Appl. No.: 11/939,088

(22) Filed: Nov. 13, 2007

(65) Prior Publication Data

US 2009/0121103 A1 May 14, 2009

(51) Int. Cl.
*A47B 96/06* (2006.01)

(52) U.S. Cl. ..... 248/220.1; 248/220.21

(58) Field of Classification Search ..... 248/220.1, 248/200, 300, 205.1, 207, 220.21, 221.11, 248/223.31, 224.8, 289.11, 239
See application file for complete search history.

(56) References Cited

U.S. PATENT DOCUMENTS 2,096,024 A 10/1937 Anderson
2,289,451 A 7/1942 Porcelli
2,389,349 A 11/1945 Eastman
4,727,815 A 3/1988 Miller
4,971,865 A 11/1990 Nowlan
5,513,575 A 5/1996 Slade
5,810,317 A 9/1998 Macchi
D418,044 S 12/1999 Schoeneweis
6,171,540 B1 * 1/2001 Ibaragi ..... 264/328.1
6,364,261 B1 4/2002 Vass, Jr.
D476,550 S 7/2003 Jorgensen
6,828,035 B1 12/2004 Goettl
6,905,101 B1 * 6/2005 Dittmer ..... 248/274.1
D561,748 S * 2/2008 Sculler et al. ..... D14/239

* cited by examiner

*Primary Examiner*—Terrell Mckinnon
*Assistant Examiner*—Erin Smith

(57) ABSTRACT

A corner bracket system for hanging objects at the junction of two walls, such as in the corner of a room, and a method for using the same. The system comprises a wall bracket, a mounting bracket, and a slide pin. The wall bracket and mounting bracket each have a plurality of complementary, transverse support members that are readily engageable and are securable using the slide pin.

8 Claims, 4 Drawing Sheets

CORNER BRACKET SYSTEM FOR WALL HANGINGS AND METHOD FOR USE

BACKGROUND OF THE INVENTION

The present invention relates to bracket systems for wall hangings, and specifically to corner wall bracket systems for securely hanging objects such as conventionally mounted big game trophies at the junction of two walls, and a method for using the same.

Devices for hanging objects on a wall are well known. Some of these devices are directed toward hanging objects in a corner where two walls join. These devices are complex in their design and have many parts. In addition, these devices are not directed toward hanging big game trophies for the purpose of taking up less space. Therefore, there exists a need in the art for a bracket system that addresses these deficiencies.

An objective for the present invention is to provide a wall bracket system that has fewer parts.

Another objective of this invention is to provide a wall bracket that is easy to assemble.

A still further objective of this invention is to provide a wall bracket that is inexpensive to manufacture.

An additional objective of this invention is to provide a wall bracket that permits a big game trophy to be hung in the corner of two adjoining walls.

These and other objectives will be apparent to those skilled in the art based on the following drawings, written description, and claims.

BRIEF SUMMARY OF THE INVENTION

A bracket system for wall hangings has a wall bracket, a mounting bracket and a slide pin. The wall bracket and mounting bracket are each provided with complementary support members that are readily engageable and are securable using the slide pin. Objects such as conventionally mounted big game trophies are secured to the mounting bracket without the need for dismounting or remounting.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

Figure 1:
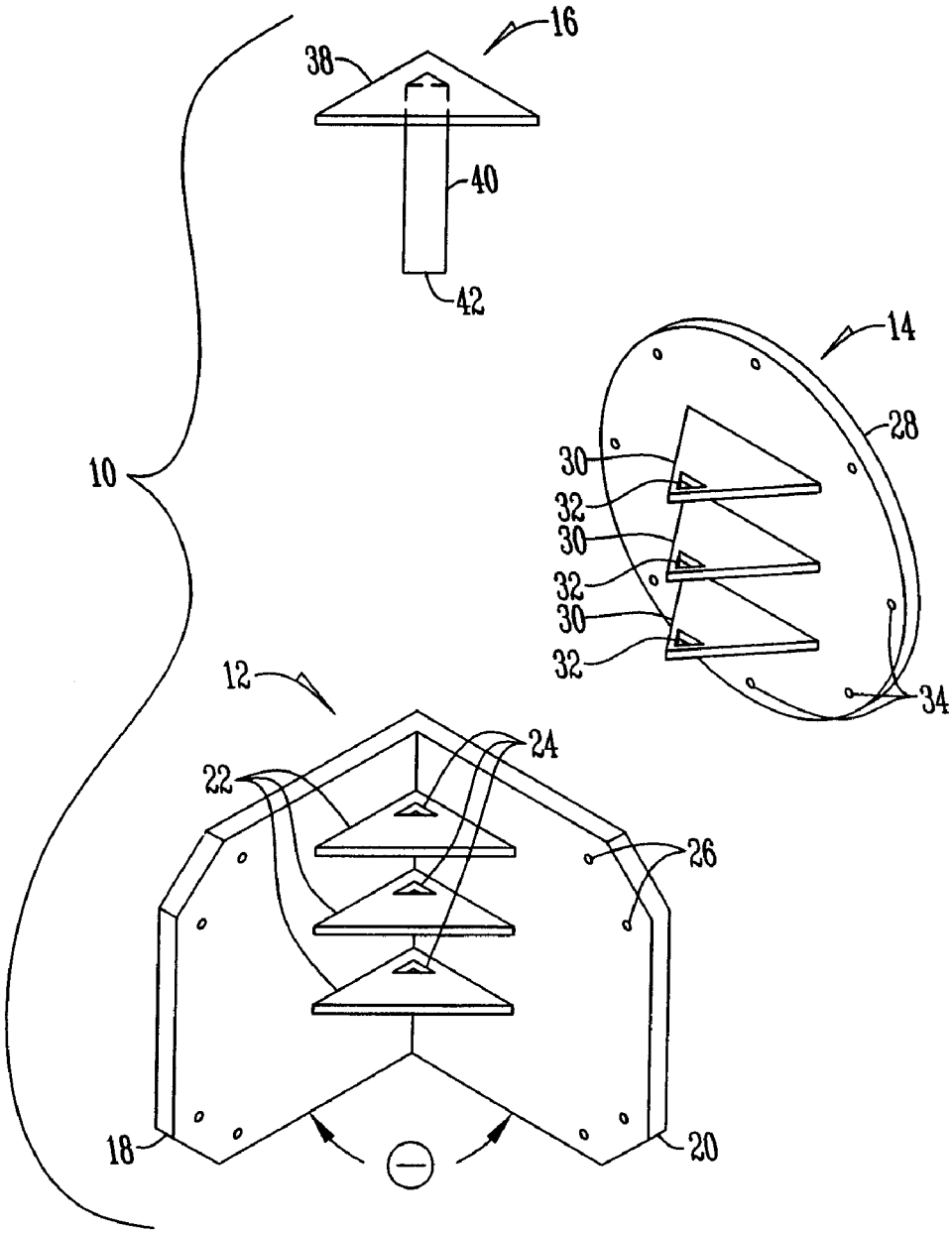
FIG. 1 shows an exploded, perspective view of a bracket system.

Referring to FIG. 1, corner bracket system 10 comprises a wall bracket 12, a mounting bracket 14, and a slide pin 16. Wall bracket 12 further comprises a first wall member 18, a second wall member 20, and a plurality of transverse support members 22. Wall members 18, 20 are made of a suitable material such as metal, wood, plywood, particle board, pressboard or the like, and define an angle Θ therebetween that approximates the angle defined by the walls (not shown) the junction of which is the site of the desired installation. It will thus be appreciated that in a typical, 90° corner installation, Θ will be approximately 90°. The invention is not limited to 90° corners, however, and Θ can be any value up to 180°.

Transverse support members 22 are made of any suitable material such as wood, plastic or metal, and each has an aperture 24. Apertures 24 are in vertical alignment with one another and are essentially the same size and shape. Wall members 18, 20 may be provided with a plurality of holes 26 drilled or formed therethrough. For example, wall members 18, 20 could be attached to wall surfaces using screws or other fasteners, and holes 26 could be provided to accommodate a suitable type, number and arrangement of fasteners.

Still referring to FIG. 1, mounting bracket 14 further comprises a mounting face 28, and a plurality of transverse support members 30 opposite of mounting face 28. Transverse support members 30 are made of any suitable material such as wood, plastic or metal, and each has an aperture 32. Apertures 32 are in vertical alignment with one another and are essentially the same size and shape as apertures 24 in transverse support members 22 of wall bracket 12. Mounting face 28 is provided with a plurality of holes 34 drilled or formed therethrough. The object to be hanged (not shown) is attached to mounting bracket 14 at mounting face 28, and holes 34 could be provided to accommodate a suitable type, number and arrangement of fasteners.

Transverse support members 22 of wall bracket 12 and transverse support members 30 of mounting bracket 14 are matingly engageable such that apertures 24, 32 are vertically aligned. Preferably, transverse support members 30 are provided to fit within wall bracket 12, between wall members 18, 20, and have an engaging surface that is angular with an angle of approximately Θ.

Slide pin 16, comprising a head 38, a body or shaft 40, and an end 22, is slidably disposed within apertures 24, 32. Body 40 of slide pin 16 is generally the same size and shape as apertures 24, 32, and frictionally engages the support members as it is inserted into and through the apertures therein, thereby securing mounting bracket 14 to wall bracket 12. Head 38 of slide pin 16 is larger than apertures 24, 32 and pin body 40.

Figure 2:
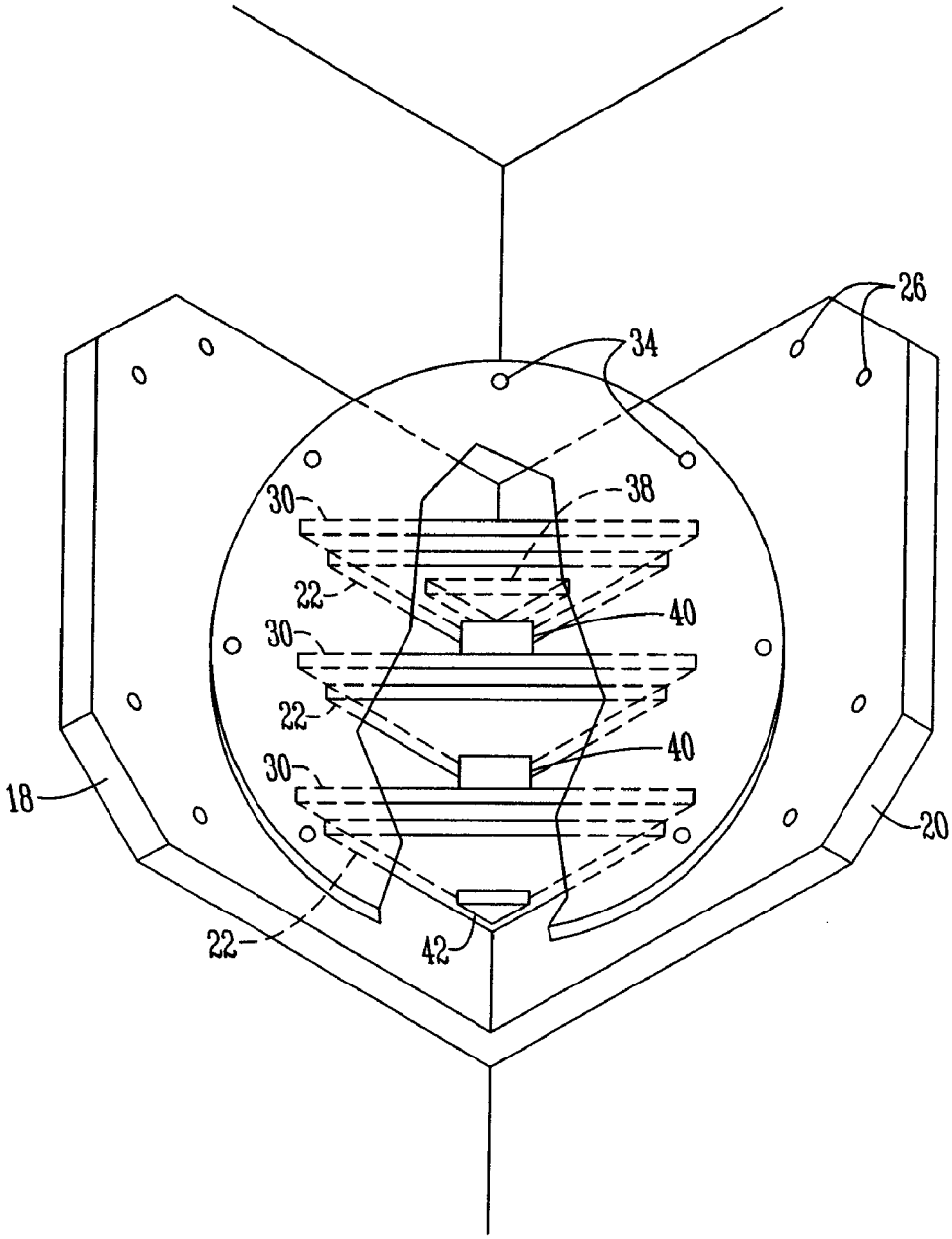
FIG. 2 shows a perspective, cutaway view of a bracket system.

As shown in FIGS. 1 and 2, apertures 24, 32 and pin body 40 are generally triangular, however, any shape or size may be used. Other shapes include round or circular as well as other geometric shapes such as square, rectangular, pentagonal, hexagonal or other polygonal forms. It will be appreciated that head 38 of slide pin 16 can be essentially any shape and size so long as head 38 does not fit into any of apertures 24, 32. Slide pin 16 is slidably disengaged from corner bracket system 10, thereby detaching wall bracket 12 from mounting bracket 14 as the respective support members are disengaged.

The engagement of transverse support members 22 with transverse support members 30 can be accomplished in a number of ways. The only requirement is that the support members and apertures therein are complementary such that the apertures are capable of vertical alignment, but there is no requirement that the same number of respective support members 22, 30 be provided. The support function of wall bracket 12 is preferably enhanced where at least one transverse support member 30 rests on a corresponding transverse support member 22. See FIG. 2. In one embodiment of system 10, transverse support members 22, 30 are present in a 1:1 ratio and the corresponding pairs are substantially equally interspaced. The uppermost transverse support member 30 is further secured by head 38 of slide pin 16.

The foregoing invention may be used in the following manner. Wall bracket 12 is mounted to adjoining walls at a desired height by placing fasteners such as screws through holes 26 in wall members 18, 20. The object to be hanged, such as a conventionally mounted big game trophy, is secured to mounting face 28 of mounting bracket 14 in a desired orientation by placing fasteners such as screws through holes 34.

Transverse support members 30 on mounting bracket 14 are engaged with transverse support members 22 on wall bracket 12 so that all of the apertures 24, 32 are vertically aligned. Body 40 of slide pin 16 is inserted through apertures 22, 32 until head 38 of slide pin 16 engages the uppermost transverse support member. Corner bracket system 10 may be disassembled by slidably disengaging slide pin 16 from the system.

Figure 3:
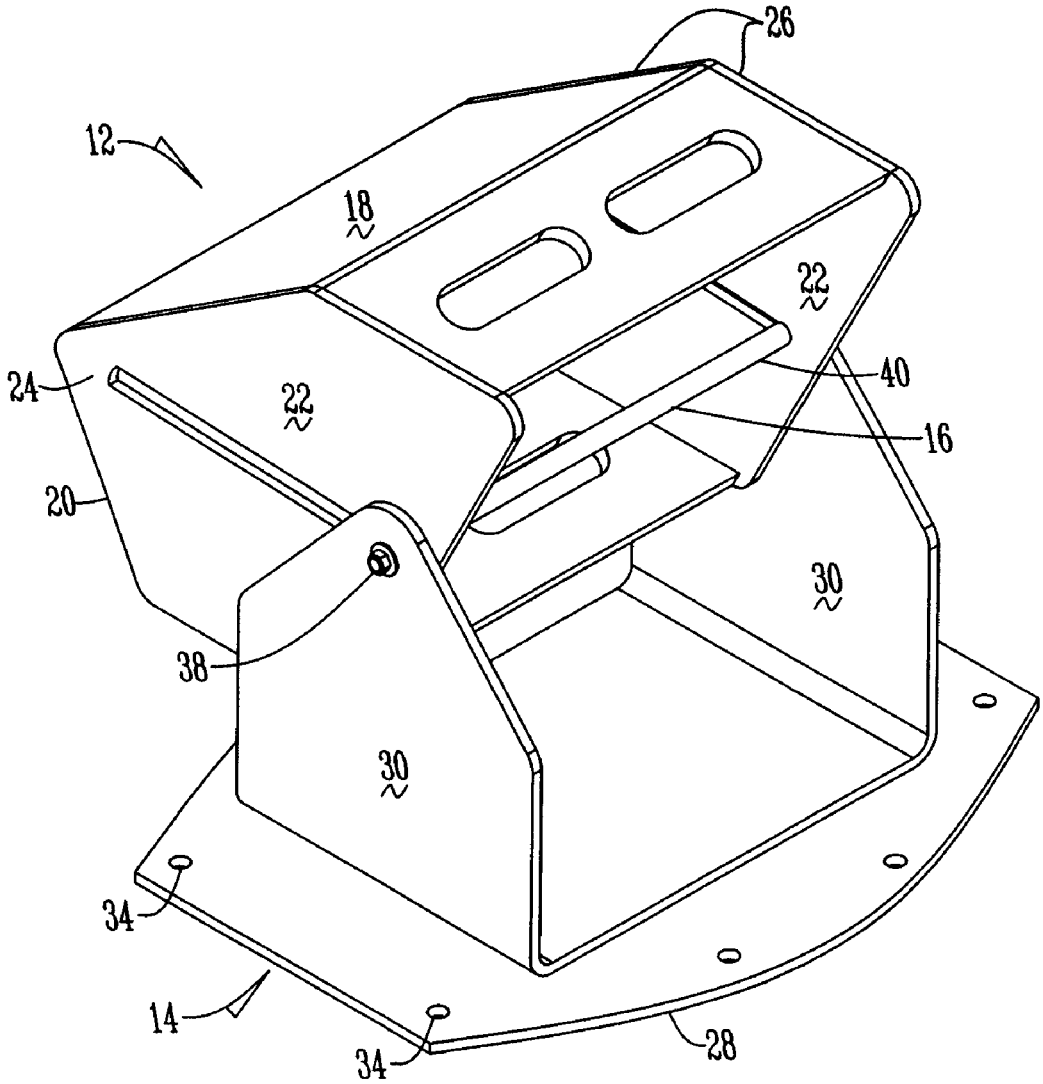
FIG. 3 shows a perspective view of an alternative bracket system.

In an alternative embodiment, shown in FIG. 3, apertures 24 defined by transverse support members 22 of wall bracket 12 are elongate. Body 40 of slide pin 16 is movable within the length of apertures 24. Head 38 of slide pin 16 engages the uppermost transverse support member 30 of mounting bracket 14. Persons skilled in the art will appreciate that the movement of slide pin 16 relative to wall bracket 12 will increase or decrease the relative distance between wall bracket 12 and mounting bracket 14, e.g. via telescoping, thereby affording adjustability to allow for wall hangings of varying size and shape.

Figure 4:
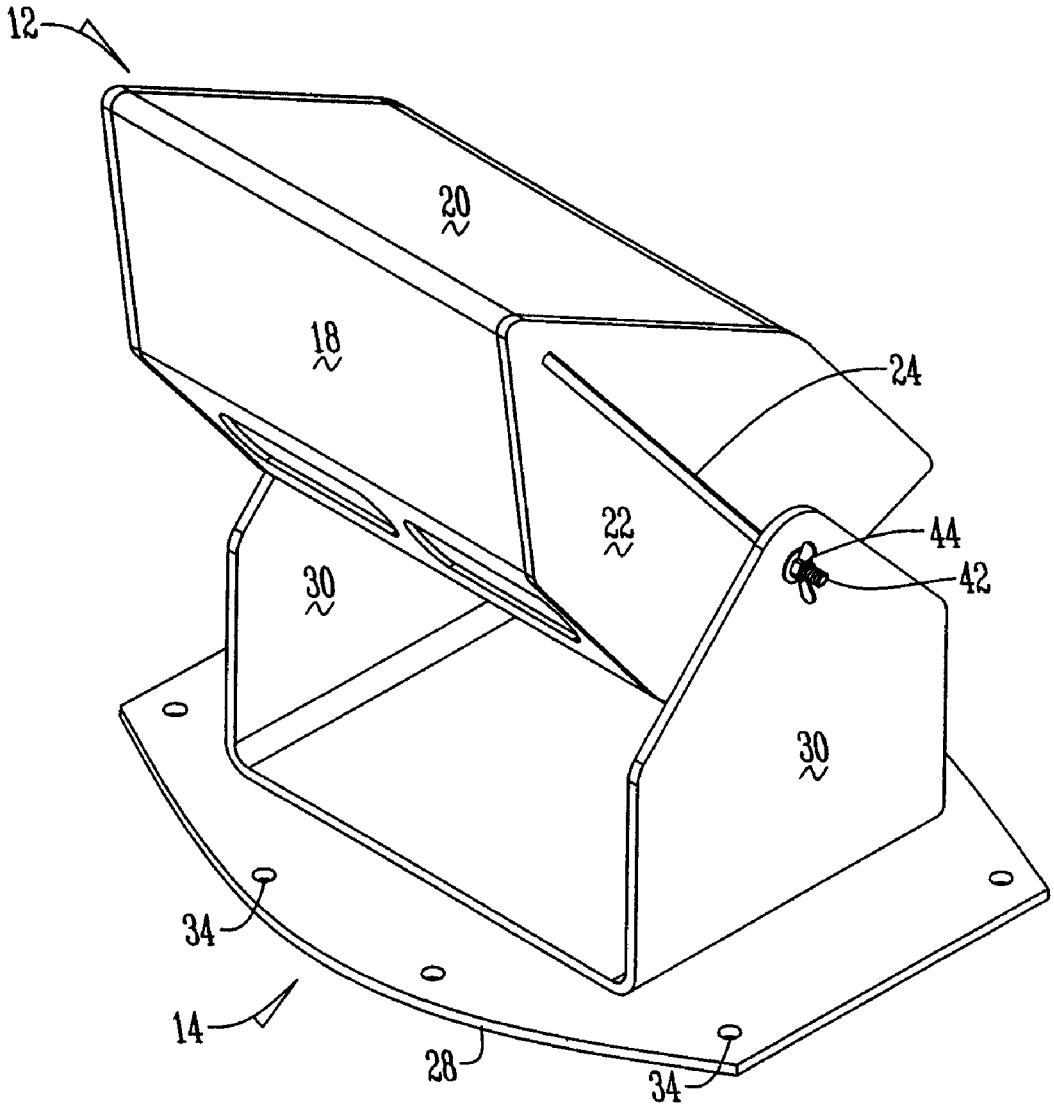
FIG. 4 shows a perspective view of an alternative embodiment.

Still referring to FIG. 3, mounting bracket 14 pivots about slide pin 16 relative to wall bracket 12, further providing adjustability with respect to mounting and viewing angles, for example. Turning to FIG. 4, both telescoping and pivot of mounting bracket 14 with respect to wall bracket 12 about slide pin 16 are selectably restricted. End 42 of slide pin 16 is frictionally secured to the lowermost transverse support member 30. Preferably, end 42 is threaded and threadably engages a fastener 44 such as a wing nut. As fastener 44 is tightened about end 42, fastener 44 frictionally engages transverse support member 30 and movement of slide pin 16 within apertures 32 is restricted, thereby limiting telescoping and pivot of mounting bracket 14.

Thus, a corner bracket system has been disclosed that at the very least meets all the stated objectives.

What is claimed is:

1. A bracket system for hanging objects at the junction of two walls, comprising:

a wall bracket having a first plurality of transverse supports, each of said transverse supports defining an aperture therein;

said wall bracket further comprising a first wall member and a second wall member defining an angle therebetween that is substantially the same as the angle defined by said junction of two walls;

a mounting bracket having a second plurality of transverse supports, each of said second plurality defining an aperture therein, said second plurality being matingly engaged with said first plurality of transverse supports such that said apertures are vertically aligned and at least one of the second plurality of transverse supports rests on a corresponding first plurality of transverse supports;

said mounting bracket further comprising a mounting face opposite said second plurality of transverse supports; and a slide pin having a head and a body, said body being slidably disposed through said apertures.

2. The bracket system of claim 1, wherein said apertures and said slide pin body are substantially the same size and shape as one another, and are smaller than said slide pin head.

3. The bracket system of claim 1, wherein said the shape of said apertures and said slide pin body is selected from the group consisting of circular and geometric.

4. The bracket system of claim 1, wherein said first and second wall members are provided with a plurality of holes therethrough.

5. The bracket system of claim 1, wherein said mounting face is provided with a plurality of holes therethrough.

6. The bracket system of claim 1 wherein said first plurality of transverse supports and said second plurality of transverse supports are present in a 1:1 ratio, correspondingly engaged pairs of which are substantially equally interspaced.

7. The bracket system of claim 1 wherein the head of said slide pin engages the uppermost of said second plurality of transverse support members and wherein the end of said slide pin distal from the head is secured to the lowermost of said second plurality of transverse support members.

8. The bracket system of claim 1 wherein said mounting bracket is pivotable about said slide pin and in relation to said wall bracket.

* * * * *